United States Patent [19]

Eriksson

[11] Patent Number: 4,568,100

[45] Date of Patent: Feb. 4, 1986

[54] VARIABLE SPAN DEVICE FOR SKIS

[76] Inventor: Karl G. V. Eriksson, Egersundsvägen 30, S-59150, Motala, Sweden

[21] Appl. No.: 605,653

[22] Filed: Apr. 30, 1984

[30] Foreign Application Priority Data

May 20, 1983 [SE] Sweden ..... 8302867

[51] Int. Cl.[4] ..... A63C 5/04

[52] U.S. Cl. ..... 280/602; 280/604; 280/607; 280/609

[58] Field of Search ..... 280/602, 604, 607, 609, 280/610

[56] References Cited

U.S. PATENT DOCUMENTS 2,248,008 7/1941 Miesen ..... 280/604

2,377,504 11/1945 Lermont ..... 280/601

FOREIGN PATENT DOCUMENTS 3142623 5/1983 Fed. Rep. of Germany ..... 280/604

*Primary Examiner*—David M. Mitchell

*Assistant Examiner*—Richard Camby

*Attorney, Agent, or Firm*—Laff, Whitesel, Conte & Saret

[57] ABSTRACT

The span of the ski is provided with a horizontal slit passing through the span and dividing it into an upper part and a lower part, the lower part being more easily bendable in vertical direction than the upper part. For influence of the front sole part of the ski boot is arranged a pressure member, movable in vertical direction, which member passes through upper part and is fastened to or in any other way arranged to engage with the lower part of the span.

5 Claims, 12 Drawing Figures

VARIABLE SPAN DEVICE FOR SKIS

This invention relates to a variable span device for skis. Such skis are especially meant for long distance use.

The users of touring skis and the ski-runners have the essential problem, that the skis must be greased or waxed in such a way that they have a fine glide on plane surfaces and during the run down. The running surface of the skis is therefore provided with one type of wax under the span and another type of wax on the remaining parts of the running surface. These latter parts are waxed for fine glide, whereas the span part is waxed for adherence to the snow below.

However, there is a further problem. The running surface of the span must be brought into contact with the snow below when climbing uphill, in order to enable for the wax under this part of the running surface to really serve as an adherence medium. To achieve that the skier rises on his toes in order to press down the span and thus its running surface. However, the resistance of the end span makes it often difficult to obtain the desirable engagement between the running surface in question and the snow below.

The device according to the present invention has been made in order to solve the last mentioned problem.

The invention is characterized therein that the ski span is passed through by a horizontal slit deviding it into an upper part and a lower part, the lower part being more easily bendable in vertical direction than the upper part, and that for influence of the front sole part of the ski boot is arranged a pressure member, movable in vertical direction, which member passes through said upper part and is fastened to or in any other way arranged to engage with the lower part of the span.

Figure 1:
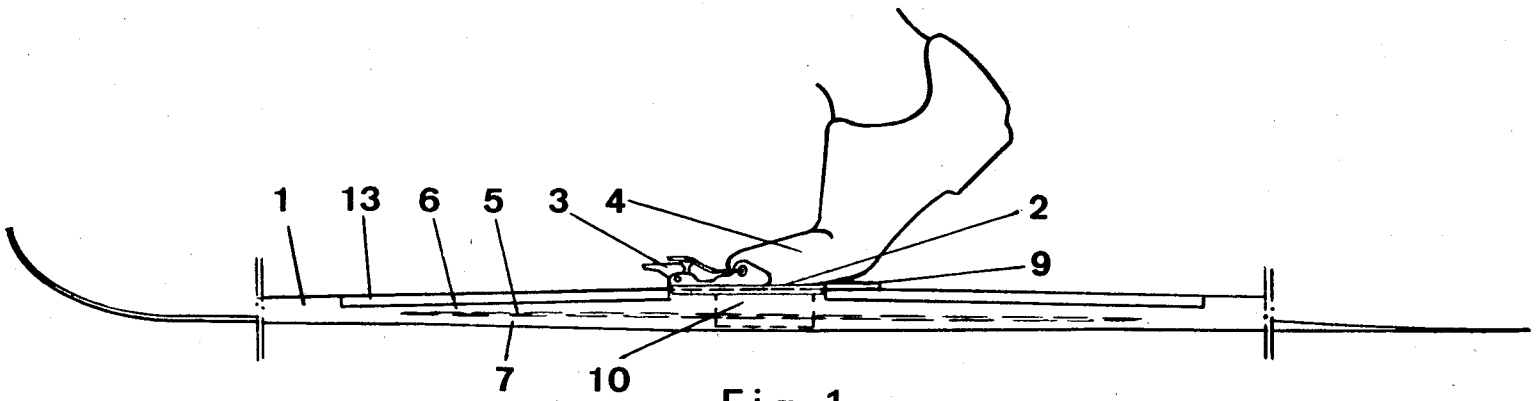
Figure 3:
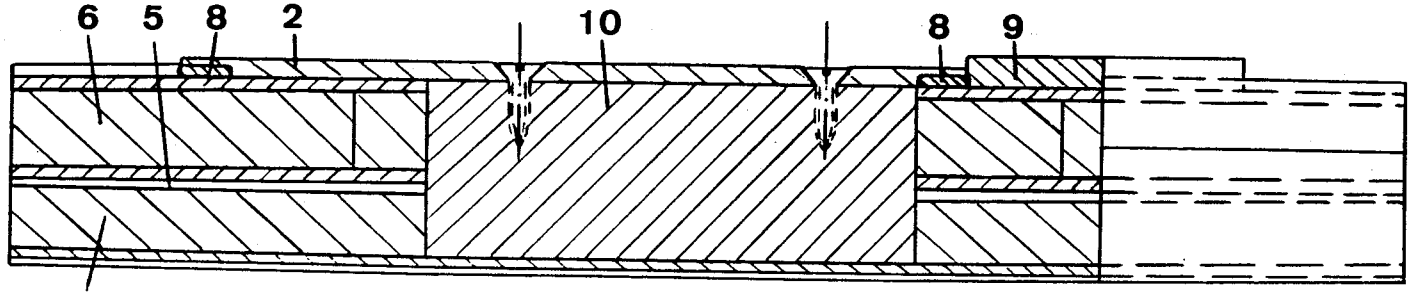
Figure 6:
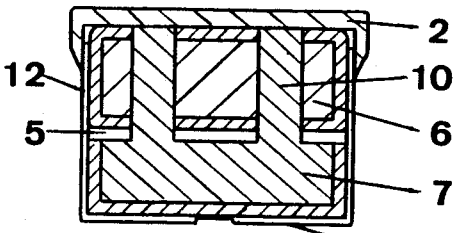
Figure 5:
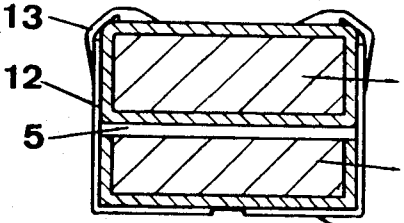
Figure 4:
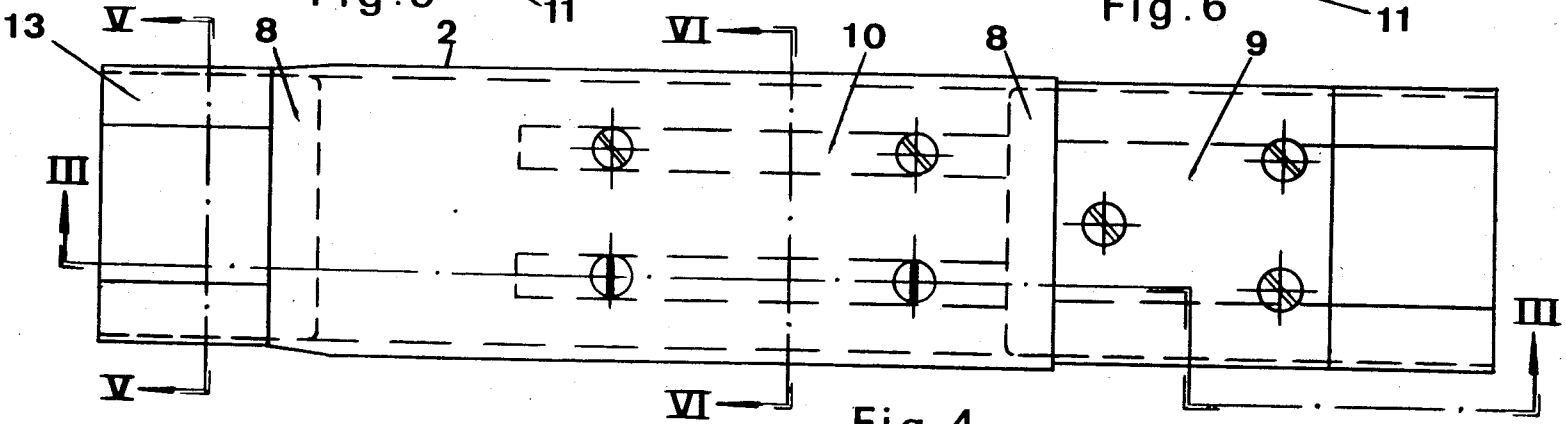
Figure 7:
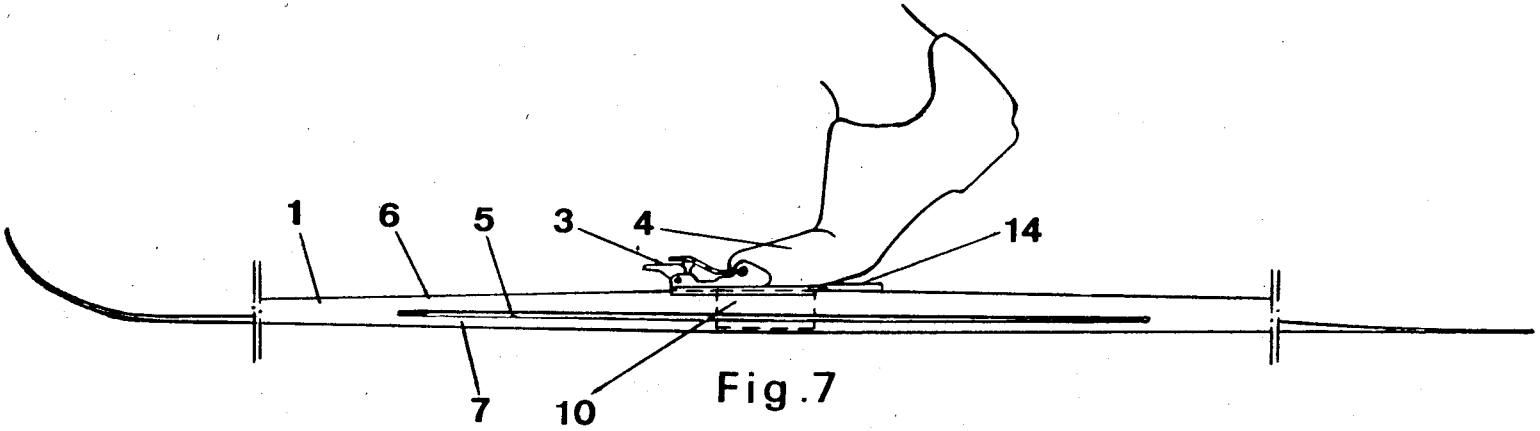
Figure 8:
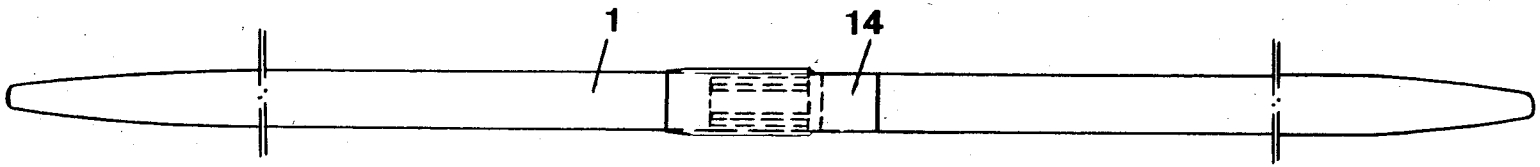
Figure 9:
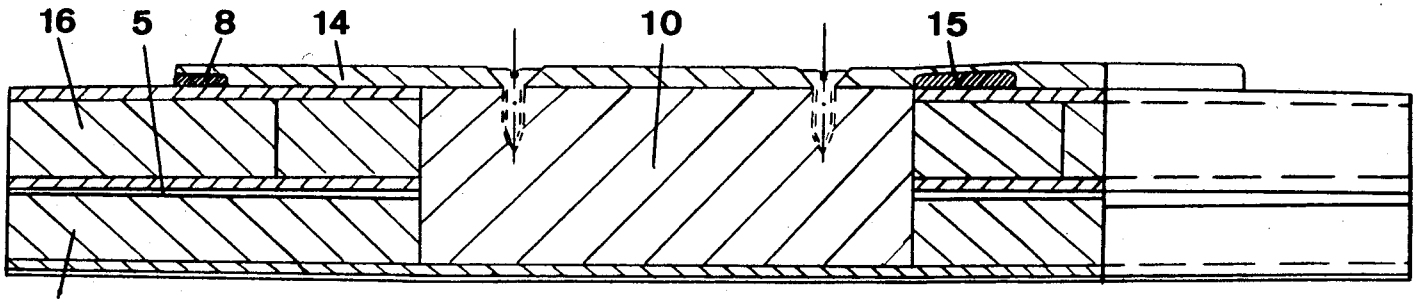
Figure 12:
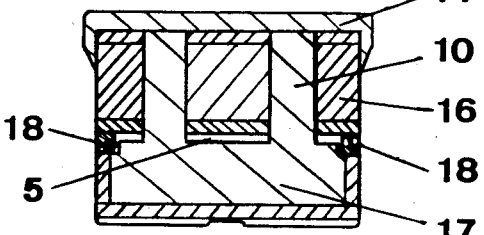
Figure 11:
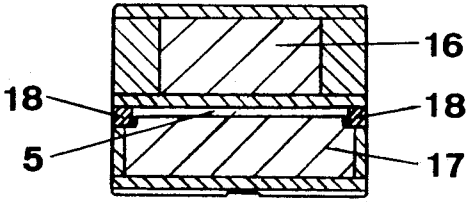
Figure 10:
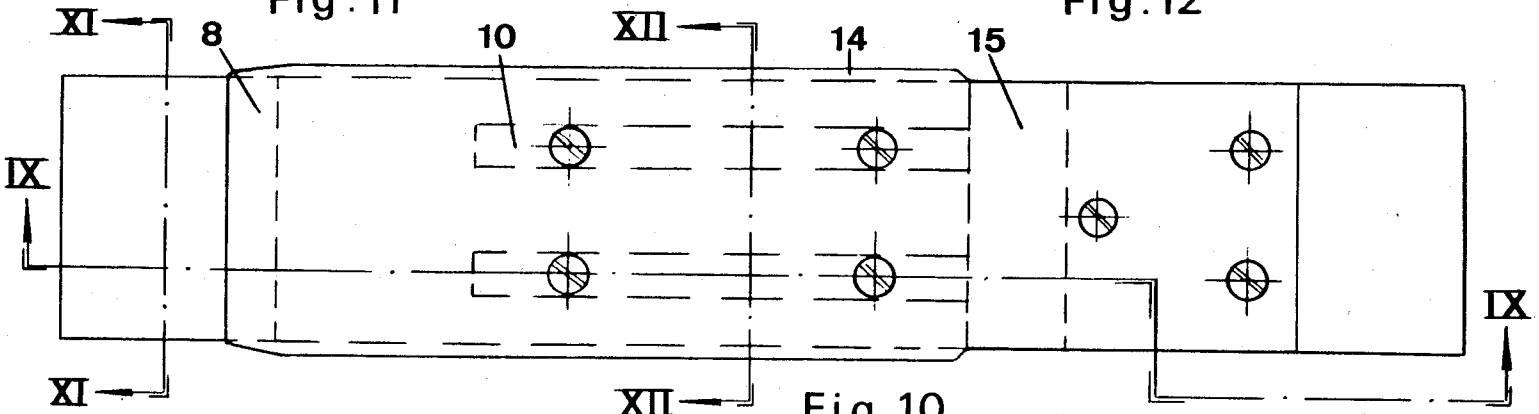

For better understanding of the invention, reference may be had to the following detailed description taken in conjunction with the accompanying drawings, in which:

FIG. 1 is a side elevational view of a ski provided with a device accordning to the invention and also showing ski-binding and a ski boot placed therein. The figure discloses the condition, when the ski-runner has risen on his toes to press down the running surface part of the span, FIG. 2 is a top plan view of the ski according to FIG. 1, but with the binding and the ski boot removed, FIG. 3 is a side elevational view in enlarged scale of a part of the ski in the span range with the details included in the device according to the invention and disclosed in the position according to FIG. 1, taken along line III—III of FIG. 4, FIG. 4 is a top plan view of the device according to FIG. 3, FIG. 5 is a cross section, taken along line V—V of FIG. 4, FIG. 6 is a cross section, taken along line VI—VI of FIG. 4, FIG. 7 is a modification of the device according to the invention and disclosed in a way corresponding to FIG. 1, FIG. 8 is a top plan view of the device according to FIG. 7, FIG. 9 is a side elevational view in enlarged scale of a part of the ski in the span range with the details included in the device according to the invention and disclosed in the position according to FIG. 7, taken along line IX—IX of FIG. 10, FIG. 10 is a top plan view of the device according to FIG. 9, FIG. 11 is a cross section, taken along line XI—XI of FIG. 10, and FIG. 12 is a cross section, taken along line XII—XII of FIG. 10.

A first embodiment of the invention will be described in conjunction with FIGS. 1–6.

Figure 2:
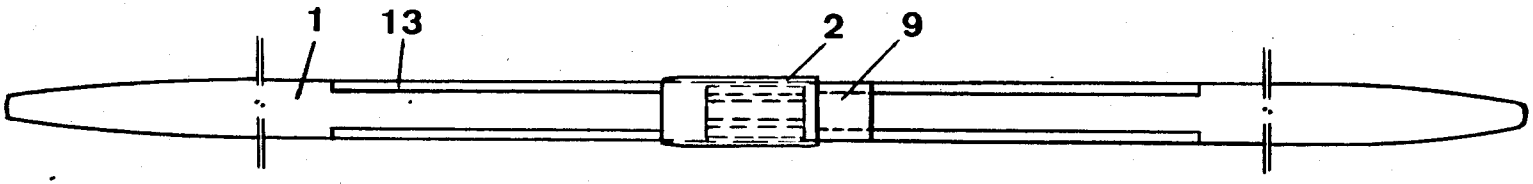

FIGS. 1 and 2 discloses a ski 1 having a foot plate 2 and a ski-binding 3 fastened to this plate. With 4 is a ski boot designated. At the span the ski is passed through by a horizontal slit 5, forming an upper part 6 and a lower part 7 of the span. The lower part 7 is so designed that it will be more easily bendable than the upper part 6.

The device is more clearly disclosed in FIGS. 3–6. There is the above mentioned foot plate 2, under the front and rear ends of which are placed transverse, resilient strip seals 8. The foot plate 2 can take different height positions above the upper side of the ski, corresponding to the varying width of the slit 5. Thereby the strip seals 8 prevent snow from being pressed in under the foot plate. Behind the foot plate 2 is by screws fastened a support plate 9.

The lower part 7 of the span is provided with two upstanding pressure members 10, which pass through the upper part 6 and to which the foot plate 2 is fastened by screws. Of course the pressure members can be loose from the lower part 7, but may rest against this part.

The upper part 6 and the lower part 7 may be manufactured by means of any known technique and may consist of for instance wood or fibre composites, possibly with foam filling, or a mixture of different materials.

As is best seen in FIGS. 5 and 6 the ski is provided with a coated sole 11, which from the underside of the ski extends upwards along the two ski sides to form side coatings 12. In order to prevent snow from being pressed in at the upper edges of the side coatings 12 corner seals are located on the places above the span, where these coatings must adapt themselves to the different width of the slit 5 during the use of the ski.

All the FIGS. 1–6 show the device on the occasions when the ski-runner wants to have the adhering surface under the span in contact with the snow below. He then rises on his toes, as is shown in FIG. 1, whereby the foot plate 2 is actuated and through the pressure members 10 presses down the lower part 7, so that the slit 5 from being closed is widened to the position shown. The lower part 7 of the span with its coated sole 11 is brought into an improved engagement with the snow, so that the ski-runner can get more strength for the running and thereby higher speed when climbing uphill.

When thereafter the heel of the ski boot 4 is brought back to the upper side of the ski the influence of the ski boot on the pressure members 10 ceases, why the lower part 7 with the coated sole 11 can return to their upper normal positions, where the coated sole under the span is free from the ski track and the ski-runner can glide forward on his skis only with their front and rear parts in contact with the ski track.

A second embodiment of the invention is disclosed in FIGS. 7–12.

The ski body 1 with the ski-binding 3, the ski boot 4 and the horizontal slit 5, deviding the span in an upper part and a lower part, is here provided with a differently designed foot plate 14, which extends further backwards than the foot plate 2 in the embodiment according to FIGS. 1–6 in order to eliminate the extra support plate 9. Instead the foot plate 14 has been made thinner above its rear transverse, resilient strip seal 15, which is wider than the corresponding strip seal in the first embodiment. Thus, the foot plate 14 can articulate above said strip seal in order to enable the vertical movement of the foot plate.

The upper part 16 and the lower part 17 has been laminated in another way than the corresponding parts 6 and 7 in the first embodiment without changing their function. In this case the ski 1 is provided with only a coated sole without any side coatings. In order to seal the slit 5 side seals 18 have been inserted, which are active the whole time during the varying width of the slit 5.

This embodiment functions in analogous way as the embodiment according to FIGS. 1–6.

I claim:

1. A device comprising a ski having a horizontal slit transversely formed across the entire width and along a length of the span of the ski for dividing it into upper and lower parts, each of said parts having a vertical flexibility characteristic wherein the lower part is more flexible than the upper part, binding means for attachment to the toe of a ski boot so that the heel of the boot may raise as the skier walks or runs while wearing the ski, and means for securing said binding means along a length of the upper part and to said lower part which causes a flexing of said ski in response to the movements of a walking or running foot, whereby movement of said ski boot separately flexes said upper and lower parts of said ski, thus causing said slit to open and close.

2. The device of claim 1 wherein said binding means comprises a foot plate attached at said upper part of the ski and a toe receiving means on said plate for applying a fastening pressure to the toe of the ski boot.

3. The device of claim 1 and a coating on the bottom of the ski which extends upwardly along two vertical sides of said ski to cover the sides of the horizontal slit.

4. The device of claim 3 and means at the upper edges of said coating for sealing the coating against the ski to prevent the entrance of snow into said slit.

5. The device of claim 1 and means for covering the slit on opposite sides of said ski for preventing entry of snow into said slit during the vertical opening of said slit.

* * * * *